United States Patent [19]

Traver et·al.

[11] 4,258,102

[45] Mar. 24, 1981

[54] SILICONE COMPOSITIONS FOR TREATING GYPSUM BOARD

[75] Inventors: Frank J. Traver, Troy; William J. Raleigh, Watervliet, both of N.Y.

[73] Assignee: General Electric Company, Waterford, N.Y.

[21] Appl. No.: 58,042

[22] Filed: Jul. 16, 1979

[51] Int. Cl.[3] ..... B32B 5/16; B32B 13/08

[52] U.S. Cl. ..... 428/331; 428/334; 428/335; 428/336; 428/447; 428/448; 428/449; 428/447; 260/29.2 M; 260/33.4 SB; 428/537; 428/452; 427/387; 427/383.3; 427/374.1

[58] Field of Search ..... 428/391, 429, 450, 447, 428/539, 448, 449, 331, 334–336; 525/100; 260/33.4 SB, 29.2 M; 427/374 R, 387, 383 A

[56] References Cited

U.S. PATENT DOCUMENTS

| | | | |
|---|---|---|---|
| 2,726,176 | 12/1955 | Hatcher | 428/447 |
| 3,389,042 | 6/1968 | Bieri | 428/447 |
| 3,431,143 | 3/1969 | Johnson | 428/447 |
| 3,511,699 | 5/1970 | Johnson | 428/447 |
| 3,716,399 | 2/1973 | Nitzsche | 525/100 |
| 3,914,476 | 10/1975 | Nitzsche | 428/447 |
| 3,933,729 | 1/1976 | Letoffé | 525/477 |
| 4,066,594 | 1/1978 | Moeller | 428/447 |

*Primary Examiner*—Ellis P. Robinson

*Attorney, Agent, or Firm*—E. Philip Koltos; J. L. Young; Michael J. Doyle

[57] ABSTRACT

Gypsum paper is treated with a mixture of a silanol containing organopolysiloxane polymer where the polymer has a viscosity varying from 1,000 to 1,000,000 centipoise at 25° C. and in which there is mixed a liquid suspension of colloidal silica.

28 Claims, No Drawings

SILICONE COMPOSITIONS FOR TREATING GYPSUM BOARD

BACKGROUND OF THE INVENTION

The present invention relates to silicone compositions and more particularly the present invention relates to silicone compositions for treating gypsum paper to make it water repellent.

Gypsum board is well-known. Generally, gypsum board is formed by first forming the gypsum paper in paper making machines which is manufactured by driving the plies through a sizing bath which may contain alum and/or rosin for sizing the gypsum paper whereupon then the gypsum paper is formed to the desired thickness and collected off the end of the machine. Then in the manufacture of the gypsum board, the sheets of the gypsum paper are taken and there is put gypsum mixture between the sheets and the sandwich composite of gypsum paper with gypsum mixture is then semi-dried and cut to the appropriate lengths. The cut lengths of gypsum board are then put into a high temperature kiln where the final drying of the gypsum board is carried out prior to the shipping of the gypsum board composite.

There are several problems associated with the manufacture of gypsum board. First of all, when the gypsum mixture is first applied to the paper, some of the gypsum mixture migrates into the paper and crystallizes in the paper upon curing. One effect of this, is that the paper absorbs some of the water that is in the gypsum mixture and accordingly, the core of the gypsum mixture crystallizes and cures to a different crystalline mixture then the gypsum mixture at other parts of the cross section of the gypsum board. This phenomena is known as stratification and may result in weakening of the strength of the adhering of the gypsum paper to the gypsum core in the gypsum board. This stratification and weakening of the adherence of the gypsum paper to the gypsum core mixture necessitates the use of larger amounts of water in the gypsum mixture when the gypsum board is formed and accordingly, the result is longer drying times are needed for curing or completely drying the gypsum board before it is ready to be shipped. Accordingly, this results in additional expenses in the manufacture of such gypsum board which would desirably be eliminated.

Another problem that resulted from the absorption of large amounts of water by the paper from the gypsum mixture during the formation of the gypsum board was that the paper plies in the gypsum paper would be delaminated because of the excess water that was absorbed. This problem was overcome by the utilization of certain resins in the paper plies which would repell or counteract against the delamination effect of the water in the gypsum paper. However, this added to the expense of the overall production of the gypsum board.

Such effects were substantially eliminated or circumscribed considerably by the disclosure of Bieri et al U.S. Pat. No. 3,389,042 in which it is taught to treat the surface of one side of the gypsum paper with a hydrophobic silicone. The paper becomes water repellent and the paper may then be utilized, that is, that part of the side of the paper which is coated with the hydrophobic silicone, can be utilized to sandwich in between, gypsum mixture, without the resulting effects of stratification, and delamination as was experienced prior to the use of the silicones. The Bieri et al Patent discloses various types of silicone that may be utilized to treat gypsum paper, such as, expoxy functional polysiloxanes, methyl hydrogen polysiloxes, isocyanurate modified silanes and siloxanes and alkoxy functional silanes. In addition a product of a hydrogen silicone compound with a fatty acid ester, that is a poly ester polysiloxane block copolymer, is disclosed as a useful costing agent. Such silanes and siloxanes disclosed above and as set forth in the Bieri et al Patent were disclosed as being useful for the treating of gypsum paper in the formation of gypsum board so as to eliminate stratification, recalcination and delamination without the use of expensive additives or long drying times and as such were a general improvement over the prior art. However, there was a constant search to improve over the developments of the Bieri et al composition and processes.

One of these developments was the disclosure of Johnson et al U.S. Pat. No. 3,431,143, which discloses certain types of epoxy functional polysiloxanes for treating paper to it hydrophobic. The advantage of such epoxy functional polysiloxanes was that they tended to cure at a fast rate and they produce an excellent hydrophobic coat on the gypsum paper. In Johnson et al U.S. Pat. No. 3,511,699 the same expoxy functional polysiloxanes are disclosed for treating textiles as in the previous Johnson et al Patent. Accordingly, such silicones have found acceptance in the market place for utilization as water repellent treating agents for gypsum paper in the manufacture of gypsum board. However, there were several disadvantages with such silicone compounds.

First of all, the epoxy polysiloxanes while curing rapidly still did not cure at a sufficiently fast rate for the gypsum board manufacturing requirements. Thus, the gypsum paper that is treated with epoxy functional siloxanes had to be stored for a certain amount of time to allow the epoxy silicone to fully cure before the paper could be utilized to product gypsum board. In addition, it was desired to improve the hold down of the silicone on the gypsum paper and to improve the strength of the silicone film that was put on the gypsum paper. To do this, it was decided to try to include a filler and specifically a silicone filler along with the polysiloxane fluid. In accordance with this concept, various types of silica fillers were tried to be incorporated into the silicone fluid, which was used to treat gypsum board. Examples of such filler are colloidal fumed silica and colloidal precipitated silica.

Both of these silicas are reinforcing silicas, that, they increase the strength of the cured film that is formed. However, it should be noted that while reference is made to the fact that those silicon are colloidal fumed silica and colloidal precipitated silica, they are semi-dried colloidal silica particles in the state in which they are incorporated into silicone compositions which contains silanol groups on the surface of the particles. The term colloidal silica, as it will utilized in this case will refer to a liquid suspension of colloidal silica particles. However, such applications is fumed silica and precipated silica, which is stated previously, that such silicas when attempted to be incorporated into silicone compositions, made the silicone emulsion in which the silicone fluid was located unstable and very difficult to keep an emulsified form, and the fumed silica and the precipitated silica had a tendency to precipitate out of the emulsion.

Reference is also made to the Patent Application of William J. Raleigh Ser. No. 826,601 entitled "Silicone Compositions Useful As Textile and Paper Coatings", which is incorporated into the present case by reference, which discloses the use of a colloidal dispersion of silica which is a liquid suspension or dispersion of silica as a filler for a paper treating composition in which the base fluid is made by emulsion polymerization and in which the base fluid has vinyl groups and is cured by being reacted with a hydrogen polysiloxane in the presence of a platinum catalyst.

Such a composition is not the composition of the instant case. The instant composition does not contain platinum nor does it cure by the crosslinking of hydrogen groups onto vinyl groups of a base polymer so as to form a silicone film by SiH-olefin addition mechanism catalyzed by platinum. In addition, the Raleigh Application, as referred to above, discloses nothing about the use of that composition or any other composition for the treating of gypsum paper in the manufacture of gypsum board.

Accordingly, it is one object of the present invention to provide for a silicone composition for treating gypsum paper which cures in a very rapid fashion and cures more rapidly than an epoxy functional silicone.

It is an additional object of the present invention to provide a silicone composition for treating gypsum paper to make it water repellent which composition results in a silicone film of acceptional strength.

It is yet an additional object of the present invention to provide for a silicone composition for treating gypsum paper to make it water repellent wherein the silicone composition in the cure state has a better hold down to the gypsum paper and it imparts to the gypsum paper increased resistance to wetting.

It is still an additional object of the present invention to provide for a silicone composition for treating gypsum paper to make it water repellent wherein the silicone composition contains a liquid dispersion of colloidal silica. These and other objects of the present invention are accomplished by means of the disclosure set forth hereinbelow.

SUMMARY OF THE INVENTION

In accordance with the above objects, there is provided by the present invention, gypsum paper, which is treated with a silicone composition to make it water repellent comprising; (1) gypsum paper, which is treated with (2) a composition comprising; (a) 100 parts by weight of a polysiloxane selected from the class consisting of the formula,

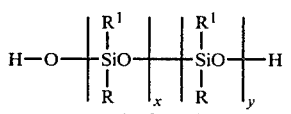

(1)

and the formula

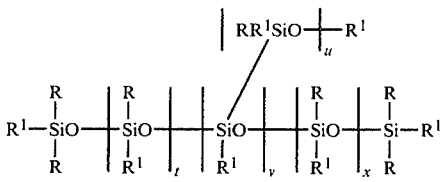

(2)

where R is a monovalent hydrocarbon radical and $R^1$ is selected from the class consisting of silanol radicals and monovalent hydrocarbon radicals and x, u, v, t, and y vary such that the polymer has a viscosity varying from 500 to 1,000,000 centipoise at 25° C; and (b) from 1 to 25 parts by weight of a liquid suspension of colloidal silica. Preferably, the polysiloxane is made by emulsion polymerization since it is easier to form an emulsion with a polysiloxane from emulsion polymerization, especially when a polysiloxane is of high molecular weight then it is to emulsify by traditional methods. In the emulsion mixture there is also present the usual, typical types of stabilizers. If it is desired to make the emulsion of the polysiloxane without emulsion polymerization then the desired polysiloxane may be emulsified with certain emulsifiers such as an alkylene phenyl ethylene oxide emulsifier, where the alkylene group has from 2 to 10 carbon atoms and where there is from 4 to 40 mole percent of ethylene oxide in the emulsifier and an alkyl phenoxy polyoxyethylene glycol where the alkyl group is from 1 to 10 carbon atoms and the emulsifier contains from 4 to 40 mole percent of ethylene oxide. Other acceptable types of emulsifiers might be utilized. It should be noted that in the polysiloxane, it is necessary that the polysiloxane contains silanol groups. It is the presence of silanol groups in the polysiloxane of the instant case that causes it to cure at the rapid rate which is evident from the reduction to practice in the instant invention.

DESCRIPTION OF THE PREFERRED EMBODIMENT

The R radical in the compounds of formulas (1) and (2) are selected from monovalent hydrocarbon radicals and more particularly from monovalent hydrocarbon radicals and halogenated monovalent hydrocarbon radicals. The $R^1$ radial is selected from the class consisting of a silanol radicals and monovalent hydrocarbon radicals and mixtures thereof. The type of radicals the R and $R^1$ radicals may be, that is when the $R^1$ radical is a monovalent hydrocarbon radical, are alkyl radicals such as methyl, ethyl, propyl; alkenyl radicals such as vinyl allyl, etc; cycloalkyl radicals such as cyclohexyl, cyclohepytyl, cyclo octyl, etc.; mononoculear aryle radicals such as phenyl, methylphenyl, ethylphenyl, etc. and halogentated alkyl radicals such as 3,3-triflouropropyl, etc. Most preferably, the R and $R^1$ radical, except when the $R^1$ radical is silanol, is selected from alkyl radicals of 1 to 8 carbon atoms such as methyl, phenyl radicals and vinyl radicals. In terms of cost, it is more preferably that the R and R' radical be methyl.

It should be noted that the above selection for the R' radicals is for the case when it is a monovalent hydrocarbon radical and not a silanol group. For proper cure of the system, it is preferred that there will be at least two silanol radicals in the molecule so that the polymer can cure properly. The polymer of Formula 1 may be made by emulsion polymerization, but it also may be produced by simpler processes. Accordingly, the polymer is Formula 1 may be produced by simply taking the appropriate cyclotetrasiloxanes such as octamethyl cyclotetrasiloxane and equilibrating with R and R' cyclotetrasiloxane in the presence of small amounts of chainstopper. The chainstopper may be water or it may be a low molecular weight silanol terminated diorganopolysiloxane polymer such as α, γ silanol hexamethyltrisiloxane. The chainstopper is produced by simply taking diorganodichlorosilane and hydrolyzing it in water and separating the hydrolyzate from the water and the acid that is formed. The equilibration of the cyclotetrasiloxanes with a small amount of chainstopper or water is carried out in the presence of an equilibration catalyst such as toluene, sulfonic acid, acid treated clay or even a basic catalyst such as potassium hydroxide. The appropriate amount of chainstopper is utilized so that the desired molecular weight of the silanol terminated diorganopolysiloxane polymers is obtained. Accordingly, utilizing this procedure there can then be obtained a silanol terminated diorganpolysiloxane polymer of Formula 1 which may or may not have silanol groups in the internal portion of the polymer chain, depending on the type of cyclotetrasiloxanes that are utilized wherein is the Formula of the compound of Formula 1, x and y varies such that the polymer has a viscosity that varies from 800 to 1,000,000 centipoise at 25° C.

The direct process by which such branched chained polysiloxanes of Formula 2 are made; the polymer can simply be made by taking trifunctional organo chlorosilanes having a high amount of trifunctionality and hydrolyzing them in water and then taking the hydrolyzate from that hydrolysis and purifying it of excess acid and of water to yield a trifunctional polysiloxane polymer. Such a polymer containing silanol groups may further be reacted with a silanol terminated organopolysiloxane polymer obtained by equilibration or by hydrolysis in a further condensation reaction where some of the silanol groups with condense out to add on the polymer moieties to each other produce a high molecular weight trifunctional polysiloxane polymer.

In addition there can be utilized chainstoppers of various types so that there can be silanol groups either in the polymer chain or on the terminal silicone atoms of the polymer chain, depending on where it is desired to have silanol groups and depending on the type of polymer that is desired to be formed. It should be noted that there can be utilized in the instant invention either a linear polymer or a branched chain polymer. It should also be noted that in Formula 2, the polymer can be either linear or branched chained. The polymer would be linear when u and v is equal to zero. In addition, although it is preferred that the silanol groups be at the terminal position of the polymer chain as in the compound of Formula 1, as shown in Formula 2, the polysiloxanes can have silanol groups in the internal position of the polymer chain and have organo substituent groups in the terminal silicone atoms. It should be noted that there could be formulated a compound within the scope of Formulas 1 and 2 with only one silanol group per molecule. However, such a polymer would cure poorly. Accordingly, it is preferred that the polysiloxane polymer of Formulas 1 and 2 have at least two silanol groups per molecule. It should be noted that with more than two silanol groups, the polymer would tend to cure even faster then with only two silanol groups per molecule. However, it is desired that the silanol content of the polymer not exceed 2% since it has more silanol content then the above, then the polymer will not cure properly since all the silanol groups will not be able to condense in a sufficiently rapid time. It is preferred that x and y, as stated previously, vary such that the polymer has a viscosity of anywhere from 500 to 1,000,000 centipoise at 25° C. It should be noted that either an x can be zero or y can be zero but both of the groups cannot be zero. In the same manner t, v, u and x in the compound of Formula 2 may vary such that the polymer has a viscosity that varies from 500 to 1,000,000 centipoise at 25° C. and more preferably has a viscosity that varies from 25,000 centipoise to 400,000 centipoise at 25° C. As noted, the compound of Formula 2 can be either linear or branched chained, although it is preferred that the polymer is linear, since it is easier to emulsify. It should also be noted that the silanol groups can be either in the polymer chain or in the terminal silicone atoms or on both silicone atoms sites. It is also preferred that the polymer have a higher viscosity since that provide the most hydrophobic coating. Accordingly, it is preferred that the polymer of Formula (1) and (2) have a viscosity in the range of 25,000 centipoise to 400,000 centipoise at 25° C. and that the silanol groups be at the terminal position of the polymer chain. Such a polymer within the above preferred viscosity ranges such as that of Formula 1 may be produced by with advantage of emulsion polymerization. It should be noted that the polysiloxanes of Formulas (1) and (2) in order to be applied to gypsum paper have to be emulsified. Accordingly, high viscosity polysiloxanes are very difficult to emulsify by traditional techniques unless there is utilized specific emulsifying agents or unless emulsion polymerization is utilized to form the polymer. An example of emulsion polymerization to be found in Findlay et al U.S. Pat. No. 3,294,725 which is incorporated by reference.

Accordingly, then a silanol terminated polymer of Formula 1 but not of Formula 2 may be formed by emulsion polymerization by homogenizing the mixtures of compounds comprising by reacting a cyclotetrasiloxane of the formula, $$(R_2SiO_4; \quad (2)$$

with a compound of the formula, $$(R\,R^1\,SiO)_4; \text{ or} \quad (3)$$

A compound of the formula $$(R\,R^1\,SiO)_4 \quad (7)$$

with a compound of the formula

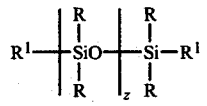

(5)

where R and R′ were previously define z varies from 1 to 20. Such compounds are equilibrated or are first homogenized along with a benzene sulfonic compound of the formula,

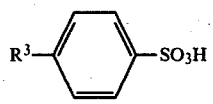

(6)

where $R^3$ is an alkyl radical containing from 1 to 20 carbon atoms and there is present sufficient water. The quantities of the cyclotetrasiloxanes are reacted are such that the entire concentrations of the R and R′ groups appear in the base polymer. The concentration of the benzene sulfonic acid may vary anywhere from 100 to 1,000 parts per million. Generally, the cyclotetrasiloxanes are homogenized with sufficient water since that there is present at a concentration of anywhere from 10 to 60% solids in a water dispersion. After these reactants and catalysts have been homogenized, then the resulting composition is heated to a temperature of anywhere from 40° to 100° C. for a period of time varying from 1 to 5 hours. A shorter reaction time may be utilized, but the reaction may not reach completion by then, and a longer reaction time serves no purpose. After a 5 hour period, or preferably a 3 hour period, then it is desired to cool the reaction mixture to room temperature for a period of time varying from 1 to 8 hours and more preferably from 2 to 5 hours. It should be noted that upon this cooling, the polymerization continues and the lower the cooling temperature, which may be down to 0° C. temperature the polymerization will continue whereupon there is obtained a polymer of a million centipoise viscosity or more. It is desired to have the composition cool to room temperature or below for that period of time so as to stabilize emulsion polysiloxane polymers of Formula 1. It is possible that some of the polymer may precipitate out of the emulsion it too rapid a cooling period is utilized or is not utilized at all. It should also be noted that the composition can be cured to below room temperature advantageously in accordance with the present invention for the foregoing period of time by the use of refrigeration. When it is desired to terminate the polymerization, then the benzene sulfonic acid is then neutralized with the appropriate amount of an alkanol amine. The result is preferably an alkanolamine of the formula, $$(R^4OH)_3N \quad (7)$$

where $R^4$ is a lower alkylene radical of 1 to 8 carbon atoms. The result is a neutralized emulsion of the polysiloxanes of Formulas 1. With respect to the benzene sulfonic acid, any of the benzene sulfonic acids falling within the scope of the above formulas may be utilized in the instant case but one that is most readily available and performs as the most efficient and most preferred catalytic agent in the process of such emulsion polymerization has been found to be dodecylbenzene sulfonic acid. Another advantage of such an acid is that it is readily available.

As far as the alkanolamine is concerned, the formula has been given above. Such alkanolamines neutralizing agents are preferred since they buffer the emulsified polysiloxane polymers and stabilize the emulsion. Other stronger basic agents may be utilized such as sodium hydroxide, potassium hydroxide, however they may tend to precipitate on some of the polysiloxane polymers of Formula 1 that have been formed. Most of the salts that are formed from such a neutralization procedure have the disadvantage that they degrade the silicone composition that is formed from the instant invention. For more information as to the details of the emulsion polymerization process by which polymers of Formulas 1 and 2 may be formed. Reference is made to the disclosure of Moeller U.S. Pat. No. 4,008,346. It should be noted that emulsion polymerization may be used to produce the polymers of Formula (2) when such polymers are linear. It should be noted that silanol polymers that are formed by such emulsion polymerization may then be reacted with branched chain low molecular weight polysiloxanes such as those of Formula (2) having silanol groups to produce a high molecular weight branch chained silanol containing polysiloxane compound still within the scope of Formula (2). However, it is not necessary to have such branch chained polysiloxanes as the polysiloxane, in the treating emulsions of the present case and there may be utilized directly the polysiloxanes formed by emulsion polymerization of Formula (1) in the invention of the instant case.

The other necessary ingredient in the reaction mixture of the present case is per 100 parts of the polymers of Formula 1 and 2, from 1 to 25 parts by weight of a colloidal silica filler. By colloidal silica it is meant a liquid dispersion of silica, that is a colloidal suspension of silica in a liquid. Another name for such colloidal suspensions of silica is silicic acid. For reference to a more complete definition and also preparation of such colloidal liquid suspensions of silica one is referred to Iler—"The Colloidal Chem. Of Silica"—1955, Cornell, U. Press, Page 87 which is hereby incorporated by reference. Preferably, such colloidal silica is utilized at a concentration of 1 to 15 parts by weight and has a pH in the range of 7.5 to 11.5. More preferably, the pH range varies from 8.5 to 10.5. It should also be noted that such a silica is also stable in the acidic stage such as pH below 5. However, it is not desired to add an acidic colloidal silica to the base polymer unless there can be found the appropriate emulsifying agents for the polysiloxane of Formulas 1 or 2. It should also be noted that the silanol groups in the polymers of Formulas 1 or 2 would have a greater tendency to condense with each other upon standing in an acidic medium then it would do on a basic; and accordingly the shelf-life of the composition would be shorter in an acidic medium. Accordingly, it is highly desirable that the pH of both the colloidal silica and the polysiloxane emulsion of Formulas 1 or 2 on the basic side and be within the 8.5 to 10.5 range in the more preferred manner.

It should be noted that such colloidal silica in the instant invention is present as a liquid dispersion and more generally a water or alcohol dispersion of silica colloidal particles.

Such a colloidal silica is not fumed silica or precipitated silica or other semi-dired forms of silica which are present in the form of powders normally and which have silanol groups on the surface of the powdered particles. In such silicas even though the particles are of a colloidal size, nevertheless, this is not the type of silica that would be utilized in the instant invention because of the instability that it imparts to the emulsion. What is meant by colloidal silica, is a silica which is a colloidal suspension in water or in alcohol or a mixture of water and alcohol and which is added as such to the polysiloxanes of Formulas 1 or 2 after they have been emulsified. Basically, such a colloidal silica and as explained in the Iler reference, is dispersed in a liquid consisting of water or an aliphatic alcohol having 1 to 8 carbon atoms wherein the colloidal silica has a particle size varying from 1 to 100 microns and a surface area varying from 100 to 500 square meters per gram. The colloidal silica is utilized at a concentration of 30 to 70% solids in water wherein the colloidal silica has a silanol content that varies from 1 to 25% by weight. If ordinary fumed silica or any powdery type of silica is dispersed in water and added to the emulsified compounds of Formulas 1 and 2, such a mixture will not be as stable as the emulsified mixtures of the instant case and the silica will have a tendency to precipitate out of the emulsion.

In preparing the emulsified composition of the present case, preferably the compounds of Formula (1) or (2) is emulsified first, whether it be formed by emulsion polymerization or otherwise, and the acid catalyst is added and a emulsifier and then heated to carry out the emulsion polymerization of the composition. Then the composition is cooled and neutralized to produce the desired emulsified polymer of Formula 1. However, alternatively, the polymers of Formula 1 and 2 are already formed, may be taken and they may be homogenized and then added to them emulsifying agents and the composition can be again put into a colloidal mill to emulsify and stabilize the mixture. Accordingly, in the emulsification of such compositions of Formulas 1 and 2, in which the compounds are already formed, there is prepared an emulsion by traditional means utilizing the polysiloxances of Formulas (1) and (2) such that there is 5 to 70% by weight of silicone solids and such that there is present from 30 to 95% by weight of water and per 100 parts of the polysiloxane there is present from 1 to 10 parts by weight of the emulsifier selected from the class consisting of alkylene phenyl ethylene oxide emulsifiers where the alkylene groups have from 2 to 10 carbon atoms and where there is from 4 to 40 mole percent of ethylene oxide or emulsifiers where are alkyl phenoxy polyoxyethylene glycol where the alkyl group is from 1 to 10 carbon atoms and the emulsifier contains from 4 to 40 mole percent of ethylene oxide. These are the preferred emulsifiers for the compositions of the instant case, however, other emulsifiers which are found suitable may be utilized. It should be noted that larger amounts of the emulsifiers may be utilized in the instant compositions, however, no advantage is gained thereby after a certain point since the emulsion is just stable as at the lower amount of emulsifier but the cost of the composition is increased by the use of excess emulsifier. Other emulsifiers that can be utilized to emulsify the compounds of the instant case, that is of Formulas 1 and 2, sorbitan monolaurates, sorbitan oleates, sorbitan palmitates, sorbitan stearates in combination with ethoxylated sorbitan esters and polyvinyl alcohol may be utilized to emulsify the polysiloxanes of Formulas (1) and (2).

It should be noted that the above emulsifiers are exemplary only and other emulsifiers that are found suitable may be utilized to emulsify the polysiloxanes of Formulas 1 and 2 in accordance with the instant case. If the polysiloxane of Formula 1 is formed by emulsion polymerization then the above list of selected emulsifiers may be utilized as additional emulsifier stablizing additives to the compositions. Irrespective of whether the emulsion is formed by emulsion polymerization or by the more normal procedure of emulsification of the polysiloxanes of Formulas (1) and (2) there may be added to the composition, 1 to 10 parts by weight per 100 parts of the polysiloxances of Formulas 1 or 2 is an emulsifier stablizer which is preferably selected from N-lauryl myristyl beta propionic acid, dioctyl ester of sodium sulfosuccinic acid, sodium lauryl ether sulfate, octyl phenoxypolyethoxy ethanol and polyoxyethylene cocoamine. There may also be added small amounts of bactericides to the composition such as 0.01% to 0.1% by weight of bactericide such as formalin and other types of bactericides so as to cut the growth of bacteria in the composition. Accordingly, various other additives may be added to the composition for one reason or another. The basic ingredients that are necessary in the compositions of the instant case are the polysiloxane of Formulas (1) or (2) or a mixture thereof, the colloidal suspension of silica and the emulsifier. There are no hard and fast limitations on the emulsifier because the emulsifier can vary as desired depending on the particular emulsified properties desired in the composition. The preferred concentrations and the preferred types of emulsifiers hav been indicated above, however, these can vary depending on the application that is desired for the gypsum board application and depending on the particular type of emulsification properties desired in the emulsion.

It should be noted that the composition must be emulsified prior to being applied to the gypsum board otherwise, it is very difficult to apply the composition evenly on the gypsum board. The emulsified composition is normally cut to about 5% or less solids and then applied to the gypsum paper by dipping, spraying or applying with a roller or with a glass rod or what have you. The resulting composition is then heated at a temperature of 75° C. to 500° C. If there is utilized a curing catalyst in the composition, then the temperature of heating is 75° to 150° C. for a period of time varying from 1 second to 10 minutes. If there is no curing catalyst in the composition then the temperature of heating the composition varies from 100° to 500° C. for a period of time varying from 1 second to 10 minutes. There may be utilized as curing catalyst for the composition and particularly for the polysiloxanes of Formulas 1 and 2, a metal salt of a carboxylic acid. Generally, there may be utilized anywhere from 0.01 to 5% by weight and more preferably from 0.01 to 5% by weight of metal of tin metal salt of a carboxylic acid as a curing catalyst in the composition based on the silidone solids. Most preferably if the metal is tin and the preferred type of metal salt is dibutyl tin dilaurate. Accordingly, there may be emulsified and added to the emulsion prior to the application of the composition of the gypsum paper the foregoing concentration is of a tin salt of a caboxylic acid where the concentration is 0.01 to 5% and the preferred range of 0.01 to 2% by weight of catalyst is based on the weight of the silicone solids with the percentage being given as tin or as the metal.

If it is still desired to speed up the cure further, there may be added to the composition from 0.1 to 10 parts by weight per 100 parts of the polysiloxanes of Formulas 1 or 2 of a hydrogen containing organopolysiloxane having a viscosity varying from 10 to 1,000 centipoise at 25° C. where the organo group has in the polysiloxane is selected from the class consisting of hydrogen and monovalent hydrocarbon radicals. The foregoing monovalent hydrocarbon radicals can be any of the radicals given for R defining the compounds of Formulas 1 or 2. However, a methyl hydrogen polysiloxane is not necessary in the instant composition and thus it can be utilized the metal salt or then can be utilized no metal salt and the paper simply heated in the range of 200° to 500° C. for a period of time varying from 1 second to 10 minutes or more preferably heated for a period of time varying from 1 second to 1 minute.

Even in the absence of a catalyst the compositions of the instant case will cure at a much more rapid rate than was the case with prior art silicone compositions and specifically there is the case with the expoxy functional silicone compositions which were used in the past to coat gypsum paper. After the heating step the gypsum paper can be simply taken and utilized in the gypsum mill to form gypsum board.

Cobb's test was utilized to test the treated paper in the Examples below. Such a test comprises taking or utilizing a standard Cobb size tester.

Gurley Co., Troy, NY.

Such tests are carried out by taking a 5"×5" treated or untreated samples which were dried at 120° F. and then the dry weight measured. The Cobb tester or ring was condition at 120° F. for 20 minutes. Paper samples were secured between the rubber retaining barriers, which is 110 millimeter diameter range and 150 mm of 120° F. water was poured into the Cobb sizing tester on the treated, or as the case, the untreated sample surface. The water remaining in contact with the paper 5 minutes and was then poured off. The sample was removed from the testing device and the surface was freed from standing water. The wet sample weight was then measured. The Cobb value was determined as different in wet and dry weight in grams.

The examples are given for the purpose of illustrating the present invention and are not given for purpose of setting limits, restrictions or definitions to the invention. All parts are by weight.

EXAMPLE I

There was first taken 53.25 parts of water and one part of dodecylbenzene sulfonic acid and the mixture was agitated for 15 minutes to dissolve the catalyst. Then there was added to this mixture 35.0 parts by weight of dimethyl cyclotetrasiloxane. The resulting mixture was agitated rapidly until homogeneous said 30°±5° C. The premix had a milky emulsion like appearance prior to homogenation. The resulting mixture was prehomogenized at 8000 psi into a stainless steel beaker. After the homogenation was completed the mixture was transferred to a glass round bottom flask equipped with stirrer, heating element, thermometer with temperature control and condenser. The resulting mixture was heated to 85° C. and held for 2 hours until the heating period was completed. The vessel was cooled to 40°±2° C. and held to allow polymerization to proceed. Agitation was continued for three hours with a cooling water bath to reduce the temperature. At the end of the whole period there was added 0.6 parts by weight of triethanol amine to the mixture to neutralize the acid catalyst. Agitation was continued for half an hour. At the end of that point, there was added 0.10 parts and 0.05 parts of two types of bactericides. The pH was then tested and if the pH was less than 7 there was added 0.03 percent by weight of triethanolamine and retested. If the pH was 7 or above, the mixture was cooled at 35° C. and the colloidal silica was added. In this case, there was added 10.0 parts by weight of colloidal silica dispersed in water that a 10.0 parts of colloidal suspension of silica which is Nalcoag 1050 sold by Nalcoag Chem. Companies DuPont.

The resulting material was then filtered to yield the desired emulsified composition and next to treat gypsum paper to yield the desired emulsified gypsum paper treating composition of the instant case. There was added ½ parts to this composition of sodium lauryl ether sulfate stabilizer. The gypsum paper was treated in accordance with the Cobb test and this emulsified composition and was also treated with an epoxy polysiloxane sold by Union Carbide Corp. under the Tradename UC-RE-29. The emulsions were applied in a factory using standard equipment and emulsions were applied to a 1% solids level. The amount of silicone applied is about 1 lb. per ton of board. The Cobb values were obtained on the dried and cured paper for the epoxy silicone of Union Carbide then was obtained without any cure at 0.6 gms as a Cobb value and with the cured material there was obtained 0.4 gms as a Cobb value. With an emulsified polysiloxane of the instant case there was obtained without any cure a Cobb value of 0.6 gms and with the uncured composition that was obtained a Cobb value of 0.4 gms. With untreated paper there is obtained a Cobb value of 1.0 gms.

EXAMPLE 2

To emulsified polymer prepared in accordance with the instant invention in accordance with the disclosure of Example 1, there was added as a stabilizer as an additional 1.2 solids to the emulsifier stabilizer N-lauryl myristyl beta amino propionie acid which hereinafter shall be reffered to Sample 1. Dioctyl ester of sodium sulfosuccinic acid was added to a sample at the same soilids as Sample 1, which shall be referred to as Sample 2. At the same solids concentration as Sample 1 that was added to the same emulsified composition sodium lauryl ether sulfate, which shall be referred to as Sample 3. At the same solids concentration as in Sample 1, then was added to the emulsified composition of the instant case of Example 1 octyl phenoxypolyethoxy ethanol which shall hereinafter be referred to as Sample 4. At the same solids concentration as in Sample 1 there was added as an emulsifier stabilizer polyoxyethylene cocoamine to emulsified composition of Example 1 which shall hereinafter be referred to as Sample 5. There was no emulsifier stabilizer additive added to a sample of the emulsified composition of the instant case of Example 1 and this hereinafter shall be referred to as Sample 6. These emulsions with a different emulsion stabilizer were adjusted to 37±1% total solids. Next two grams of each sample of emulsion was diluted to 3.4% total solids for use in a paper coating with the 9"×12" sheets of 69 cylinder board 20 mls thick was then these are coated using the ¼% solid solution. The coating was applied on a laboratory coater utilizing the No. 5 equilizer rod. The coated sheets of cyclinder board were dried 2 min. at 30° F. and then cured 10 min. at 400° F. The coating condition were designed to apply about 1.4 lbs. of silicone per ton of board, a 5"×5" sample of the cured sheet was cut and Cobb value was determined according to previously described test methods. The results are as follows in Table I below:

| Sample Number | Cobb Value (grams net) |
|---|---|
| 1 | 0.5 |
| 2 | 0.5 |
| 3 | 0.5 |
| 4 | 0.5 |
| 5 | 0.5 |
| 6 | 0.4–0.5 |
| Blank | 0.9–1.05 |

EXAMPLE 3

Comparative adhesion tests were run utilizing 2"×8" treated strips of coated cyliner board. The test pieces were from the 9"×12" sheets described in Example 2. The 2"×8" strips were coated with freshly prepared wallboard gypsum compound. About ⅛ in of coumpound was applied to the strips, air dried then oven-dried at half an hour at 100° C. Once dried at 2"×8" strips were allowed to come to room temperature the condition samples were delaminated by pulling the paper from the dry wall compound. The paper was torn and the compound adhered to the paper surface. Qualitatively, Sample 1, 2, 4, 5 and 6 appeared to have better adhesion to the paper then the Sample 3 or the blank. Adhesion was judged as very good. For example 1, 2, 4, 5, and 6, since the paper adhered to the coated surface and could only be delaminiated without the paper itself being torn or destroyed in the removal attempt. Sample 3 and the blank showed good adhesion properties, but the amount delaminated free was less than for the other examples. Therefore all test formulation performed as well as or better than the control and premature delamination due to release of gypsum from the paper is not expected. (Silicone did not function as a release agent, but allowed paper and gypsum laminate to stay intact.)

I claim:

1. Gypsum paper that is treated with an emulsified silicone composition to make it water repellent wherein said composition comprises;

(a) 100 parts by weight of polysiloxane selected from the class consisting of the formula,

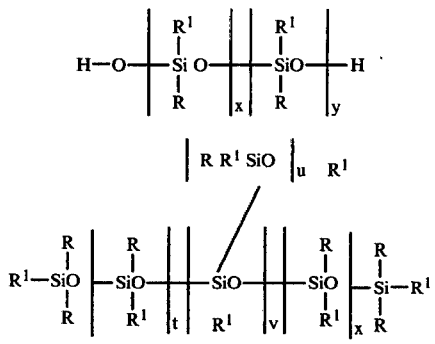

where R is a monovalent hydrocarbon radical and $R^1$ selected from the class consisting of silanol radicals and monovalent hydrocarbon radicals and x, u, v, y and t vary such that the polymers have a viscosity varying from 500 to 1,000,000 centipoise at 25° C. and at least two silanol groups per molecule;

(b) from 1 to 25 parts by weight of liquid suspension of colloidal silica.

2. The gypsum paper of claim 1 wherein the polysiloxane is prepared by a process comprising;

I. A compound of the formula, $(R_2SiO)_4$;

with a compound of the formula, $(R\,R^1\,SiO)_4$; or

II. A compound of the formula, $(R\,R^1\,SiO)_4$ with a compound of the formula,

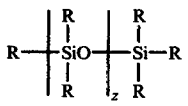

where z varies from 1 to 20.

III. Along with said compounds there being present a benzene sulfonic compound of the formula,

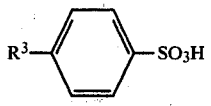

where $R^3$ is an alkyl group of from 1 to 20 carbon atoms; and with

IV. water;

(ii) heating the homogenized mixture of (i) to form said polysiloxane; and (iii) adding a neutrailizing amount of alkanol amine to said mixture to neutralize said benzene sulfonic acid and to form a neutralized emulsion of said polysiloxane.

3. The paper of claim 2 where said (ii) the homogenized mixture is heated to a temperature in the range of 40° C. to 100° C. and wherein the heating step is followed by a cooling step.

4. The paper of claim 3 wherein the benzen sulfonic acid is benzene sulfonic acid and the alkanolamine has the formula, $(R^4\,OH)_3N$ wherein $R^4$ is lower alkyl radical of 1 to 8 carbon atoms.

5. The paper of claim 1 wherein the colloidal silica is utilized at a concentration of 1 to 15 parts by weight and has a pH in the range of 7.5 to 11.5.

6. The paper of claim 5 wherein said colloidal silica is dispensed in a liquid selected from the class consisting of water and an aliphatic alcohol having 1 to 8 carbon atoms and mixtures thereof.

7. The paper of claim 6 wherein said colloidal silica has a particle size varying from 1 to 100 microns and has a surface area of 100 to 500 square meters per gram.

8. The paper of claim 7 wherein said colloidal silica is utilized at a concentration of 30% to 70% solids in water and wherein the colloidal silica has a silanol content of 1 to 25% by weight.

9. The paper of claim 1 wherein the composition is from 5 to 70% by weight of silicone solids, and there is present from 30 to 95% by weight of water and per 100 parts of the polysiloxane there is present from 1 to 10 parts by weight of an emulsifier selected from the class consisting of alkylene phenol ethylene oxide emulsifiers, where the alkylene group has from 2 to 10 carbon atoms where there is from 4 to 40 mole percent of ethylene oxide in the emulsifier; and alkyl phenoxy polyoxyethylene glycol where the alkyl group is 1 to 10 carbon atoms and the emulsifier contains from 4 to 40 mole percent of ethylene oxide.

10. The paper of claim 1 wherein the composition is from 5 to 70% by weight of silicone solids, and there is present from 30 to 95% by weight of water and per 100 parts of the polysiloxane there is present from 1 to 10 parts by weight of emulsifiers selected from the class consisting of sorbitan monolaurate sorbitan oleates, sorbitan palmitates, sorbitan stearates in combination ethoxylated sorbitan esters and polyvinyl alcohol.

11. The paper of claims 9 or 10 wherein the composition is from 5 to 70% by weight of silicone solids, and this is present from 30 to 95% by weight of water and per 100 parts of the polysiloxane there is present from 1 to 10 parts of an emulsifier selected from the class consisting of N-lauryl myristyl beta amino proprioni acid, dioctyl ester sodium sulfosuccinic acid, sodium lauryl ether sulfate, octyl phenoxypolyethoxy ethanol and polyoxyethylene cocyamine.

12. The paper of claim 1 wherein there is further present from 0.1 to 10 parts by weight of a hydrogen containing organopolysiloxane having a viscosity varying from 10 to 1,000 centipoise at 25° C. where the organo group is selected from the class consisting of hydrogen and monvalent hydrocarbon radicals.

13. A process for treating gypsum paper with an emulsified silicone composition to make it water repellent comprising; (1) applying to the gypsum paper a composition comprising (a) 100 parts by weight of a polysiloxane selected from the class of polysiloxanes of the formula,

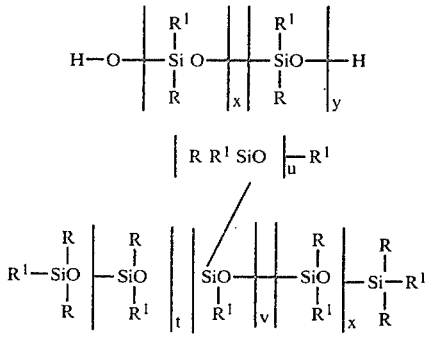

where R is monovalent hydrocarbon radical and $R^1$ is selected from the class consisting of silanol radicals and monovalent hydrocarbon radicals and x, u, v, t, and y vary such that the polymers have a viscosity varying from 500 to 1,000,000 centipoise at 25° C.; (b) from 1 to 25 parts by weight of a liquid suspension of colloidal silica; (2) heating the resulting composition to a temperature in the range of 75° to 500° C. for a period of time varying from 1 second to 10 minutes, so as to cure the composition on the paper.

14. The process for coating the gypsum paper of claim 13 wherein the polysiloxane is prepared by a process comprising;

I. A compound of the formula, $(R_2SiO)_4$;

with a compound of the formula, $(R\,R^1\,SiO)_4$; or

II. A compound of the formula, $(R\,R^1\,SiO)_4$ with a compound of the formula,

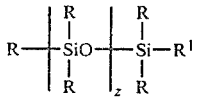

where z varies from 1 to 20.

III. Along with such compounds there being present a benzene sulfonic compound of the formula,

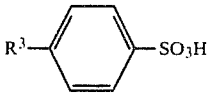

where $R^3$ is an alkyl group of from 1 to 20 carbon atoms; and with

IV. water;

(ii) heating the homogenized mixture of (i) to form said polysiloxane; and (iii) adding a neutralizing amount of alkanol amine to said mixture to neutralize said benzene sulfonic acid and to form a neutralized emulsion of said polysiloxane.

15. The process for coating gypsum paper of claim 14 wherein (ii) a homogenized mixture is heated to a temperature in the range of 40° to 100° C. wherein the heating step is followed by a cooling step in which the temperature ranges from 0° to 40° C.

16. The process for coating gypsum paper of claim 15 wherein the benzene sulfonic acid is dodecylbenzene sulfonic acid and the alkenyl amine has the formula, $(R^4\,OH)_3N$ wherein $R^4$ is a lower alkyl radical of 1 to 8 carbon atoms.

17. The process for coating the gypsum paper of claim 13 wherein the colloidal silica is utilized at a concentration of 1 to 15 parts by weight and has a pH in the range of 7.5 to 11.5.

18. The process for coating a gypsum paper of claim 17 wherein said colloidal silica is dispersed in a liquid medium selected from a class consisting of water and an aliphatic alcohol having 1 to 8 carbon atoms and mixtures thereof.

19. The process for coating the gypsum paper of claim 18 wherein said colloidal silica has a particle size varying from 1 to 100 microns and has a surface area of 100 to 500 square meters per gram.

20. The process of coating the gypsum paper of claim 19 wherein said colloidal silica is utilized at a concentration of 30% to 70% solids in water and wherein the colloidal silica has a silanol content of 1 to 25% by weight.

21. The process for coating the gypsum paper of claim 13, wherein the composition is from 5 to 70% by weight of silicone solids, there is present from 30 to 95% by weight of water per 100 parts of the polysiloxane there is present from 1 to 10 parts by weight of an emulsifier selected from the class consiting of alkylene phenol ethylene oxide emulsifiers, where the alkylene group has from 2 to 10 carton atoms where there is from 4 to 40 mole percent of ethylene oxide in the emulsifier; and alkyl phenoxy polyoxyethylene glycol where the alkyl group is 1 to 10 carbon atoms and the emulsifier contains from 4 to 40 mole percent of ethylene oxide.

22. The process for coating gypsum paper of claim 13 wherein in the process the silicone composition contains from 5 to 70% by weight of silicone solids and there is present from 30 to 95% by weight of water and per 100 hundred parts of the polysiloxane there is present from 1 to 10 parts by weight emulsifiers selected from the class consisting of sorbitan monolaurate, sorbitan oleates, sorbitan palmitates, sorbitan stearates in combination with ethoxylated sorbitan esters and polyvinyl alcohol.

23. The process for coating gypsum paper of claim 21 and 22 wherein the composition is from 5 to 70% by weight of silicone solids, and there is present from 30 to 95% by weight of water and per 100 parts of the polysiloxane there is present from 1 to 10 parts of an emulsifier stabilizer in addition to the regular emulsifiers selected from the class consisting of N-lauryl myristyl beta amino propionic acid, diotyl ester of sodium sulfosuccinic acid, sodium lauryl ether sulfate, octyl phenoxypolyethoxy ethanol and polyoxyethylene cocoamine.

24. The process of coating gypsum paper of claim 1 where there is present based on the total silicone composition from 0.01 to 5% by weight of a metal salt of carboxylic acid as metal and where a temperature of heating is in the range of 75° to 150° C. to cure the composition.

25. The process for coating gypsum paper of claim 13 wherein in step (2) the heating step, there is no catalyst for the curing and wherein the heating is carried out at a temperature of 200° to 500° C. for a period of time varying from 1 second to 10 minutes.

26. The process of claim 24 wherein Step (2) the metal salt of a carboxylic acid is dibutyl tin dilaurate.

27. The process for coating gypsum paper of claim 26 where there is further present in the composition from 0.1 to 10 parts by weight of a hydrogen containing organopolysiloxane having a viscosity varying from 10 to 1,000 centipoise at 25° C. where the organo group is selected from the class consisting of hydrogen and monovalent hydrocarbon radicals.

28. A process for forming gypsum board comprising (1) treating one side of an emulsified silicone gypsum paper so as to make it water repellent with a composition comprising; 100 parts by weight of a polysiloxane selected from the class consisting of the formula;

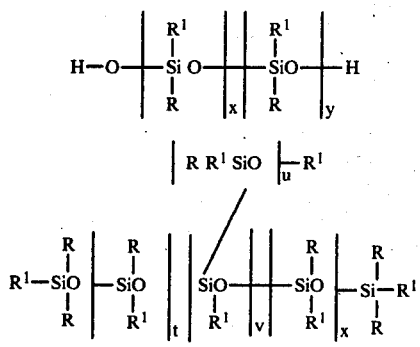

where R is a monovalent hydrocarbon radical and $R^1$ selected from the class consisting of silanol radicals and monovalent hydrocarbon radicals and x, u, v, t, and y vary such that the polymers have a viscosity varying form 800 to 1,000,000 centipoise at 250° C. and at least two silanol groups per molecule at 25° C.; (b) from 1 to 25 parts by weight of liquid suspension of colloidal silica; (2) heating the gypsum paper at a temperature varying from 75° to 500° C. for a period of time varying from 1 second to 10 minutes so as to cure the silicone composition on the paper; (3) taking the coated gypsum paper with the coated side and utilizing it to form a sandwich with Gypsum mixture between the pieces of gypsum paper such that the water repellent silicone coated side of the gypsum paper is next or adjacent to the gypsum mixture to form a composite and (4) curing the composite to form gypsum board.

* * * * *